US006110052A

United States Patent [19]

Sprager et al.

[11] Patent Number: 6,110,052

[45] Date of Patent: Aug. 29, 2000

[54] APPARATUS AND METHOD FOR ANALYZING BOWLING TECHNIQUE

[75] Inventors: David G. Sprager; Larry M. Vezina, both of Milwaukee; Daniel R. Speranza, Muskego, all of Wis.; James M. Donovan, Lakewood, Colo.

[73] Assignee: American Bowling Congress, Greendale, Wis.

[21] Appl. No.: 08/601,229

[22] Filed: Feb. 14, 1996

[51] Int. Cl.[7] ..... A63B 57/00; A63D 5/04

[52] U.S. Cl. ..... 473/55; 473/58; 340/323 B

[58] Field of Search ..... 473/54, 55, 64, 473/67, 70, 71, 72, 131, 198, 199, 200, 150, 151, 152, 409; 463/1, 30–31; 364/410; 340/323 R, 323 B; 700/91–92

[56] References Cited

U.S. PATENT DOCUMENTS

| | | | |
|---|---|---|---|
| 3,252,705 | 5/1966 | Cornberg | 273/54 |
| 3,318,598 | 5/1967 | Ruskin | 273/63 |
| 3,630,601 | 12/1971 | Lehovec | 473/200 |
| 4,136,387 | 1/1979 | Sullivan et al. | 473/200 |
| 4,137,566 | 1/1979 | Haas et al. | 364/410 |
| 4,158,853 | 6/1979 | Sullivan et al. | 348/335 |
| 4,160,942 | 7/1979 | Lynch et al. | 350/120 |
| 4,247,100 | 1/1981 | Barbee | 273/54 D |
| 4,858,922 | 8/1989 | Santavaci | 273/26 R |
| 4,893,182 | 1/1990 | Gautraud et al. | 358/105 |
| 5,118,105 | 6/1992 | Brim et al. | 273/54 C |

FOREIGN PATENT DOCUMENTS

| | | |
|---|---|---|
| 30 03 691 | of 0000 | Germany . |
| 32 07 351 | of 0000 | Germany . |

*Primary Examiner*—Mark A. Sager
*Attorney, Agent, or Firm*—Michael Best & Friedrich LLP

[57] ABSTRACT

An apparatus including a bowling lane, pins positioned on one end of the bowling lane, a bowling ball adapted to be launched down the bowling lane toward the bowling balls, and a spin detector for determining a spin rate of the bowling ball as the bowling ball travels down the bowling lane. An angle detector detects the angle of the spin axis of the bowling ball. The apparatus also measures and displays information relating to ball velocity, ball position, coefficient of friction, launch angle, and entry angle.

31 Claims, 2 Drawing Sheets

APPARATUS AND METHOD FOR ANALYZING BOWLING TECHNIQUE

FIELD OF THE INVENTION

The present invention generally relates to the field of bowling ball tracking systems and, more particularly, to systems that analyze the motion of a bowling ball and provide feedback for analyzing bowling technique.

BACKGROUND OF THE INVENTION

For improving the opportunity for bowling a strike in the game of bowling, it is generally known that a bowling ball should be thrown (i.e., "launched") so that the ball contacts the pins in the pocket between the headpin and the adjacent pin (i.e., the 1-3 pocket for right-handed bowlers and the 1-2 pocket for left-handed bowlers). Further improvements can be made by providing spin to the ball so that the ball curves and contacts the pocket at an angle relative to the longitudinal axis of the bowling lane.

Proper positioning of the ball as the ball contacts the pins will depend on a number of factors, including initial lateral positioning of the ball when launched ("launch location"), angle of the launch ("launch angle"), speed of the launch ("launch speed"), and initial spin on the ball ("launch spin"). In addition, other factors such as the coefficient of the friction between the surface of the bowling lane and the ball will also affect the positioning of the ball as it contacts the pins. For example, a lower coefficient of friction will result in less curve on the ball, thereby affecting the ball path.

To analyze a bowler's launch, it is generally known to videotape the ball as it travels down the lane. The videotape can be viewed to determine the general path of the ball. If the ball appears to travel in an improper path, the bowler can adjust the launch to attempt to remedy the problem. However, the videotape cannot indicate the specific source of any errors in the launch. More specifically, if the ball contacts the pins at an improper location, the error could be due to errors in launch location, launch angle, launch speed, launch spin, or coefficient of friction between the lane and ball (unexpectedly high or low friction). Pinpointing the specific source of the error on the videotape would, at best, be mere guesswork, and would likely take an extended period of time for analysis. This is not conducive to providing immediate feedback to the bowler so that the next launch can be compensated accordingly.

SUMMARY OF THE INVENTION

An object of the present invention is to provide an apparatus and method that can analyze the path of a bowling ball and provide feedback regarding various parameters of the ball travel. For example, the apparatus could be used to detect and display the various parameters at discrete locations along the path of the ball so that the bowler can read the parameters and render an opinion regarding the likely source of any error.

In one embodiment, the apparatus includes a bowling lane, pins positioned on one end of the bowling lane, a bowling ball adapted to be launched down the bowling lane toward the bowling pins, and a spin detector for determining a spin rate of the bowling ball as the bowling ball travels down the bowling lane. For example, the spin detector may include an imaging device (e.g., a video camera) and an indicator (e.g., an arcuate piece of tape) positioned on the bowling ball. Preferably, in order to obtain an enhanced view of the indicator, the imaging device is positioned behind the foul line of the bowling lane.

In another embodiment, the apparatus further includes an angle detector for detecting the angle of the spin axis (i.e., the spin axis angle) of the bowling ball. For example, the angle detector may include an imaging device (e.g., a video camera) positioned above the bowling lane.

The apparatus also provides a mechanism for determining a launch angle of the bowling ball as said bowling ball is launched down the bowling lane. For example, the launch angle detector can include at least two position sensors positioned adjacent to the bowling lane and separated from each other by a predetermined distance. The position sensors can include sonic positioning devices capable of emitting a sonic signal toward the bowling ball and receiving the sonic signal after the sonic signal has echoed off of the bowling ball. Preferably, the two position sensors are positioned within about twenty feet of a foul line of the bowling lane.

In yet another embodiment, the apparatus includes a mechanism for determining an entry angle of the bowling ball as the bowling ball enters the pin deck of the bowling lane. The mechanism can include at least two position sensors positioned adjacent to the bowling lane and separated from each other by a predetermined distance. For example, the position sensors comprise sonic positioning devices capable of emitting a sonic signal toward the bowling ball and receiving the sonic signal after the sonic signal has echoed off of the bowling ball. Preferably, the two position sensors are positioned within about ten feet of a pin deck of the bowling lane.

The present invention is further directed to method of analyzing a bowling technique. In one aspect, the method includes the steps of attaching an indicator (e.g., an arcuate piece of tape) to the bowling ball, launching the bowling ball down the bowling lane, imaging the bowling ball as the bowling ball travels down the bowling lane, and counting the number of times the indicator appears over a period of time as the bowling ball travels down the bowling lane to achieve a number indicative of a spin rate of the bowling ball. The indicator may be properly positioned by launching the bowling ball down the bowling lane to achieve an oil ring corresponding with the contact ring, and positioning the indicator approximately perpendicular to a portion of the oil ring. Preferably, a number corresponding with the spin rate is displayed, such as on a video display terminal or a paper printout.

In another aspect, the method includes the steps of attaching an axis mark to the spin axis of the bowling ball, launching the bowling ball down the bowling lane, imaging the bowling ball as the bowling ball travels down the bowling lane, and measuring a spin axis angle of the axis mark relative to a reference mark (e.g., the longitudinal axis of the bowling lane). The step of attaching an axis mark may be performed by launching the bowling ball down the bowling lane to achieve an oil ring on the bowling ball, and positioning the axis mark at a location that approximately defines a center axis of the oil ring. The step of measuring can include the steps of viewing the bowling ball from above, locating a measured line extending between the center of the bowling ball and the axis mark, locating a reference mark of the bowling lane, and measuring the spin axis angle between the measured line and the reference mark.

In yet another aspect, the method determines a coefficient of friction between a bowling ball and a bowling lane. The method is performed utilizing the steps of measuring velocities ($v_1$, $v_2$) of the bowling ball at two locations, measuring positions ($d_1$, $d_2$) of the bowling ball between the same two locations, calculating a friction coefficient of the bowling lane utilizing the velocities and the positions of the bowling ball at the two locations, and displaying the coefficient of friction.

BRIEF DESCRIPTION OF THE DRAWINGS

FIG. 3 illustrates a bowling ball that can be used to practice the present invention.

DETAILED DESCRIPTION

Figure 1:
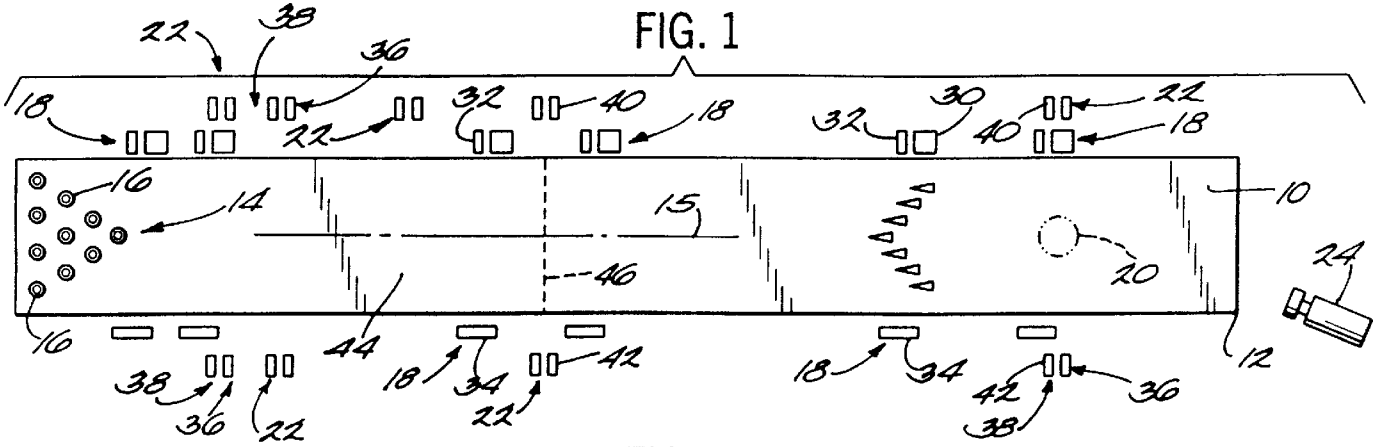
FIG. 1 is a top view of a bowling lane embodying the present invention.
Figure 2:
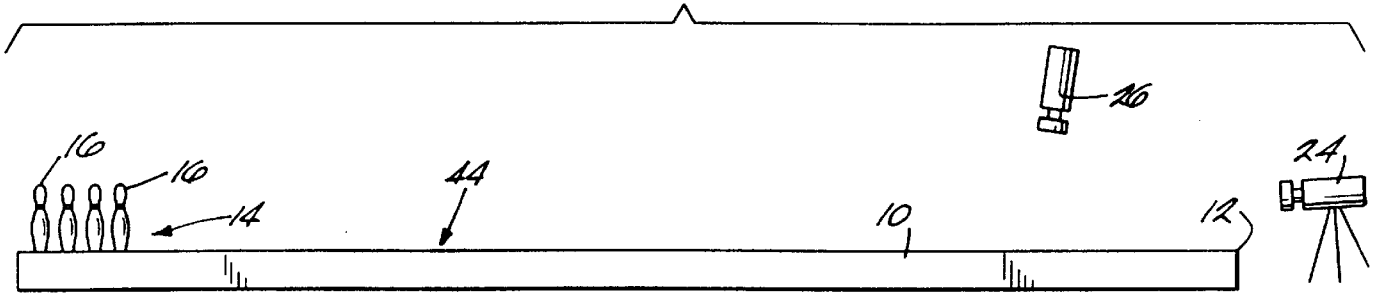
FIG. 2 is a side view of the bowling lane illustrated in FIG. 1.

One embodiment of the present invention is illustrated in FIGS. 1 and 2. The illustrated apparatus generally includes a longitudinally-extending bowling lane 10 having a foul line 12, a pin deck 14, and a longitudinal axis 15. A plurality of bowling pins 16 are positioned on the pin deck 14. Position sensors 18 (not shown in FIG. 2) are located at several locations along the side of the bowling lane 10 to measure the lateral position (i.e., perpendicular to the longitudinal axis 15 of the bowling lane 10) of a bowling ball 20 as it passes the corresponding position sensors 18. Velocity sensors 22 (not shown in FIG. 2) are similarly located at several positions along the bowling lane 10 to measure the velocity of the bowling ball 20 as it passes the corresponding velocity sensor. The position sensors 18 and velocity sensors 22 are operatively interconnected with an information processor (not shown), such as a computer, that utilizes inputs from the sensors to calculate and display various bowling parameters. A rear video camera 24 is mounted behind the foul line 12 and is used to image the bowling ball 20 for purposes of detecting the spin rate of the bowling ball 20. An upper video camera 26 is mounted above the bowling lane 10 and is used to image the bowling ball 20 for purposes of determining the spin axis angle. Each of the above-mentioned components and features is described below in more detail.

The position sensors 18 are designed to provide an accurate indication of the lateral positioning of the bowling ball 20 as the bowling ball 20 passes a predetermined position. In the illustrated embodiment, position sensors 18 are located at ten feet, fifteen feet, thirty-seven feet, forty-two feet, fifty-eight feet and fifty-nine feet from the foul line 12. It should be appreciated, of course, that the numbering and positioning of the position sensors 18 could be varied to some extent without detracting from the present invention.

Each of the illustrated position sensors 18 includes an infrared trigger operatively associated with a sonic sensor 30. The infrared trigger includes an infrared transceiver 32 positioned on one side of the bowling lane 10 and a reflector 34 positioned on the opposite side of the bowling lane 10 in opposing relation to the transceiver 32. In operation, the transceiver 32 emits an infrared signal toward the reflector 34, and the reflector 34 reflects at least a portion of that signal back to the transceiver 32. When a bowling ball 20 passes between the transceiver 32 and the reflector 34, the infrared beam is broken and the transceiver 32 immediately sends a signal indicating that the sonic sensor 30 should take a reading. Upon receipt of this signal, the sonic sensor 30 emits a pulse of ultra-sonic sound toward the bowling ball 20, and the resulting echo is reflected back toward the sonic sensor 30. The elapsed time between the start of the transmit pulse and the reception of the echo pulse is measured and provided to the information processor. Knowing the speed of sound in air, the information processor can convert the elapsed time into a distance measurement. Suitable commercially available sonic sensors can be obtained from the Polaroid Corporation under Ranging Kit part number 603972. It should be appreciated, of course, that other appropriate position sensors 18 could also be used.

The velocity sensors 22 measure the velocity of the bowling ball 20 by measuring the amount of time it takes the bowling ball 20 to travel between two points separated by a known distance. In the illustrated embodiment, a velocity sensor is positioned at each of ten feet, forty feet, forty-six feet, fifty-two feet and fifty-eight feet from the foul line 12. It should be appreciated that the number and positioning of the velocity sensors 22 could be varied to some extent without detracting from the present invention.

Each illustrated velocity sensors 22 includes a first through-beam trigger 36 and a second through-beam trigger 38. Each through-beam trigger 36,38 includes a transmitter 40 positioned on one side of the bowling lane 10 and a receiver 42 positioned on the other side of the bowling lane 10 in opposing relation to the transmitter 40. Each transmitter 40 emits an infrared light toward the corresponding receiver 42. In operation, as the bowling ball 20 passes between the transmitter 40 and the receiver 42 of the first through-beam trigger 36, a timing cycle is started by the information processor. The timing cycle continues until the bowling ball 20 passes between the transmitter 40 and the receiver 42 of the corresponding second through-beam trigger 38. The average speed between the two triggers 36,38 is calculated by dividing the distance between the triggers by the time required for the bowling ball 20 to travel that distance.

The values of lateral position and velocity measured by each position sensor and velocity sensor, respectively, can be displayed to the bowler, such as on a video display terminal or paper print out.

In addition, the lateral position values associated with the ten-foot and fifteen-foot locations can be used as an indication of the angle at which the bowling ball 20 was released by the bowler (i.e., the release angle). For example, the release angle can be calculated according to the following equation:

$$\text{angle}_{release}=\tan^{-1}(p_{15}-p_{10}/60)$$

[$p_{10}$, $p_{15}$=lateral position (inches) at ten and fifteen foot locations, respectively]

In addition, utilizing the lateral positions of the bowling ball 20 associated with the fifty-eight foot and fifty-nine foot locations, the angle of the bowling ball 20 as it enters the pin deck 14 (i.e., the entry angle) can be calculated. The entry angle can be calculated according to the following equation:

$$\text{angle}_{entry}=\tan^{-1}(p_{59}-p_{58}/12)$$

[$p_{58}$, $p_{59}$ lateral position (inches) at fifty-eight and fifty-nine foot locations, respectively]

Additional position sensors for measuring additional angles can be used to better define the ball path to the pins. Preferably, both the release angle and the entry angle are displayed to the bowler on either a video display terminal or a paper print-out.

When analyzing a bowling technique, it is sometimes useful to have information relating to the frictional interaction between the bowling ball 20 and the bowling lane 10. This is particularly relevant in the un-oiled portion 44 of the bowling lane 10 starting at the forty foot location 46 and extending through the pin deck 14. As an indication of this frictional interaction, the illustrated apparatus utilizes the velocity measurements at forty feet, forty-six feet, fifty-two feet and fifty-eight feet to calculate a friction coefficient. More specifically, the velocity at one location is compared to the velocity at a different location according to the following formula:

$$C_{friction}=\tfrac{1}{2}\, g\times v_1^2-v_2^2/(d_2-d_1)$$

[$v_1$, $v_2$=velocity at location one and two, respectively; $d_1$, $d_2$=position of corresponding velocity sensors 22]

g=Gravitational force−32.2 ft/sec$^2$

The calculated coefficient of friction provides an indication of the extent to which the velocity of the bowling ball 20 decreases over a given distance. If the velocity decreases significantly over the measured distance, then the coefficient of friction will be relatively high. This will occur, for example, when there is sliding contact between the ball and the bowling lane 10. Alternatively, if the velocity of the bowling ball 20 does not significantly decrease between the two positions, the coefficient of friction will be relatively low. This may correspond, for example, with rolling contact between the bowling ball 20 and the bowling lane 10.

Figure 4:
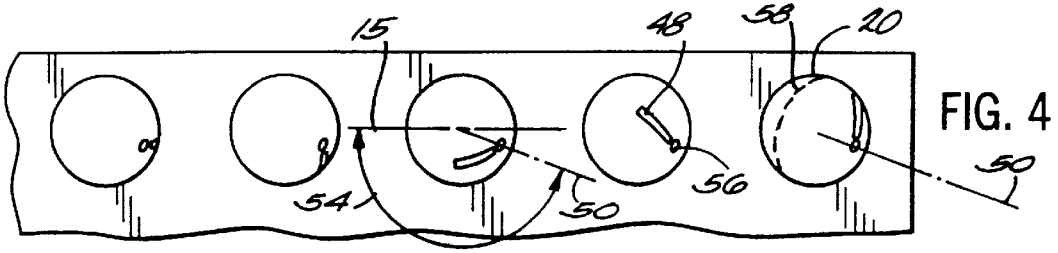
FIG. 4 is a top view of a bowling ball as it travels down a bowling lane of the present invention.

The rear video camera 24 is designed to provide information relating to the spin rate of the bowling ball 20. In the illustrated embodiment, this is accomplished by viewing the bowling ball 20 as it travels down the bowling lane 10, and counting the number of times the bowling ball 20 rotates over a given distance. More specifically, the bowling ball 20 is provided with an arcuate indicator 48 in the form of a piece of tape. The indicator 48 is positioned such that it extends from the spin axis 50 of the bowling ball 20, and has a length of about one quarter of the circumference of the bowling ball 20, as illustrated in FIG. 3. Preferably, the indicator 48 extends toward the grip holes 52 (not shown in FIG. 4) of the bowling ball 20. As the bowling ball 20 travels down the bowling lane 10 with spin, the indicator 48 will appear to rotate around the spin axis 50, as illustrated in FIG. 4. For right-handed bowlers, the spin axis 50 will usually be visible from the left rear of the ball. Accordingly, the rear video camera 24 preferably is located as illustrated. For left-handed bowlers, the rear video camera 24 can be positioned to view the right rear of the ball.

The rear video camera 24 is used image the bowling ball 20 as it spins down the bowling lane 10. The video can then be viewed, frame by frame, and the rotation of the indicator 48 can be counted over a predetermined period of time. For example, if a standard VHS format video recorder is used, the recording speed is thirty frames per second. Accordingly, to count the rotation of the bowling ball 20, the indicator 48 can be viewed over ten frames, and the resulting count can be multiplied by 180 to obtain a spin rate of the bowling ball 20 in revolutions per minute (rpm). Alternatively, the rotation of the indicator 48 can be broken down into "hours" on a clock. That is, one complete rotation of the indicator 48 would correspond with twelve hours. The number of "hours" that the indicator 48 rotates in ten video frames (i.e., one third of a second) is then multiplied by fifteen to obtain the spin rate in rpm.

The upper video camera 26 is used to measure the spin axis angle 54 (FIG. 4) of the bowling ball 20 as it travels down the bowling lane 10. The spin axis angle 54 can be any angle that provides information regarding the location of the spin axis 50. Referring to FIG. 4, the spin axis angle 54 of the illustrated embodiment is the angle between the spin axis 50 and the longitudinal axis 15 of the bowling lane 10, when viewed from above. To measure the spin axis angle 54, an axis mark 56 in the form of a piece of tape is place on the spin axis 50 of the bowling ball 20. If properly placed, the axis mark 56 should appear almost stationary as the bowling ball 20 travels down the bowling lane 10. The upper video camera 26 images the bowling ball 20, and the resulting image can be viewed to measure the spin axis angle 54.

The above-described indicator 48 and axis mark 56 can be properly positioned on the bowling ball 20 in the following manner. First, the contact ring of the bowling ball 20 must be determined. This can be done by launching the ball down the lane in the usual manner, resulting in an oil ring 58 being formed on the bowling ball 20 (FIG. 4). The oil ring 58 corresponds with the contact ring. The spin axis 50 is located an equal distance from all points on the oil ring 58 (i.e., perpendicular to the oil ring 58). The axis mark 56 is placed on the spin axis 50. The indicator 48 extends from the spin axis 50 toward the oil ring 58.

Preferably, the information relating to spin rate and spin axis angle 54 are displayed on the above-mentioned video display terminal and/or paper printout.

Figure 5:
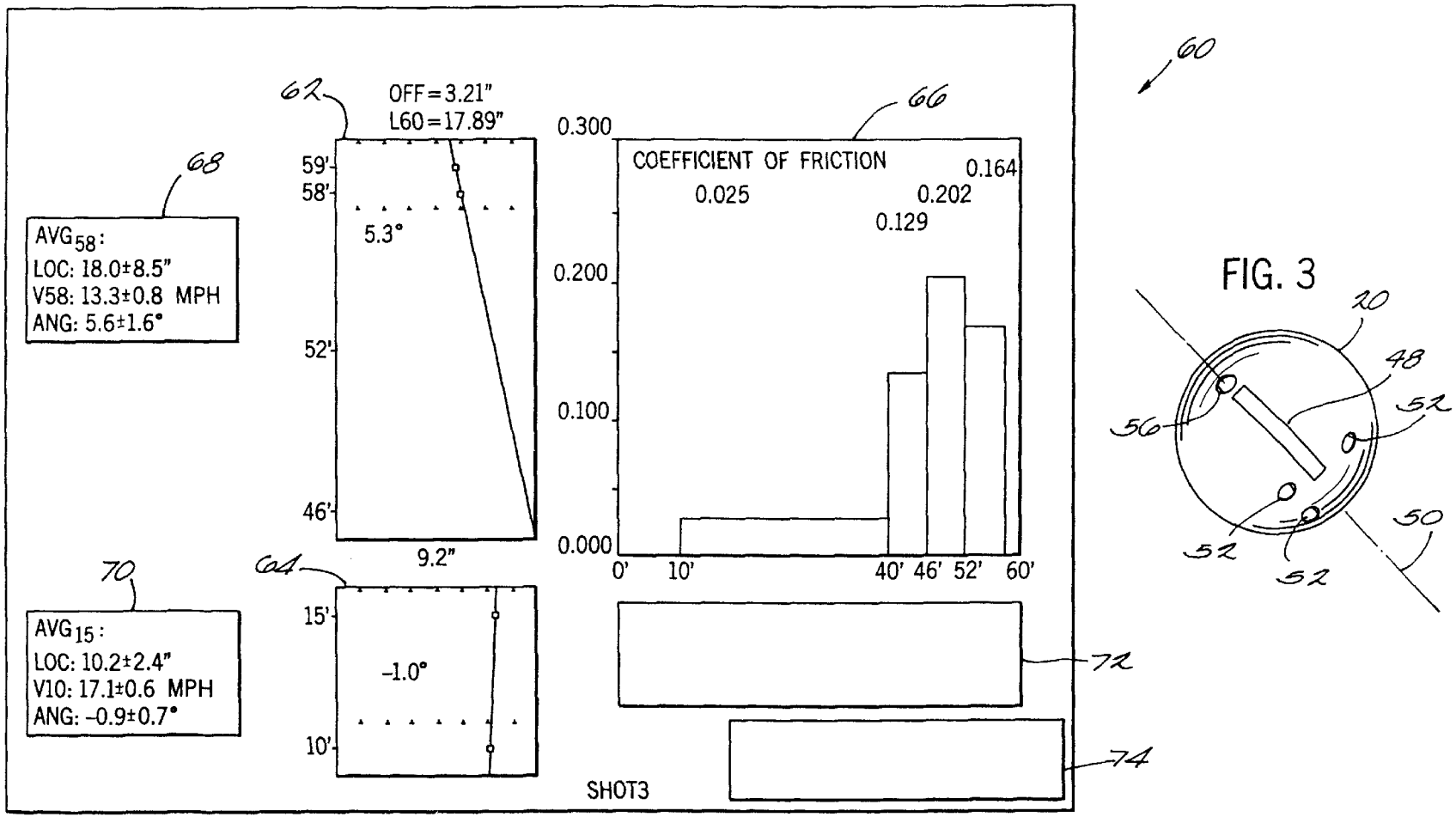
FIG. 5 is a display that provides information regarding the travel of the bowling ball.

In the illustrated embodiment, information relating to the travel of the bowling ball 20 is displayed on a video display terminal. The video display terminal includes a display 60 as illustrated in FIG. 5. The display includes an entry angle box 62 that illustrates the angle of the path of the bowling ball 20 at the 58 foot location. As noted briefly above, such angle is calculated utilizing the lateral position data points at the 58 foot and 59 foot locations. In addition, the display includes a release angle box 64 that illustrates the release angle of the path of the bowling ball 20 between the 10 foot and the 15 foot locations. The release angle is calculated utilizing the lateral position measurements at the 10 foot and 15 foot locations. A friction box 66 provides a graphical illustration of the coefficient of friction as the ball travels down the bowling lane 10.

The video display terminal display 60 also indicates the position of the ball when it contacts the head pin. Referring to FIG. 5, this is displayed above the entry angle box 62. L60 indicates distance of the ball from the right edge of the lane and OFF indicates offset or the distance the ball is from the center of the head pin. For example, the 3.21" indication illustrated means the ball was 3.21 inches to the right side of the head pin center and a minus sign before 3.21" would mean that the ball was 3.21 inches to the left side of the head pin center. These indications can be used as a measure of a bowler's true accuracy at hitting his or her target within the head pin pocket.

The final position of the ball at the point it reaches the pins can be used to measure and develop accuracy. For example, a final ball position offset 2½ inches from the right side of the head pin center could be considered an ideal strike because the ball travels through the pins and all the pins fall without contacting any kick backs while a final ball position offset 3½ inches from the right side of the head pin center could be considered more of a lucky strike because some of the pins rebound off kickbacks. A scoring system could be devised where the former type strikes are given a higher score than the latter type.

The described apparatus further has the ability to monitor a plurality of throws (i.e., "shots") of a bowling ball 20. For example, in the illustrated embodiment, the apparatus will display the average lateral position, velocity and angle of the bowling ball 20 at the 58 foot location, as shown in the $AVG_{58}$ box 68 in FIG. 5. Similarly, the $AVG_{15}$ box 70 displays the average lateral position, velocity and angle of the path of the bowling ball 20 at the 15 foot location.

The other illustrated boxes 72,74 can be used to display any desired information. For example, instructions for using the system could be provided. In addition, information regarding the location of the alignment arrows could be provided.

In addition to being used for analyzing and developing a blower's deliver, the present convention can be used to analyze differences in bowling equipment, such as balls, lanes and lane oil.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. An apparatus for analyzing bowling technique, comprising:

a bowling lane;

a plurality of pins positioned on one end of said bowling lane;

a bowling ball launched down said bowling lane toward said bowling pins; and spin means for determining a spin rate of said bowling ball as the bowling ball travels down said bowling lane; and detecting means for detecting a spin axis angle of said bowling ball.

2. An apparatus as claimed in claim 1, wherein said spin means comprises:

an indicator positioned on said bowling ball; and an imaging device positioned to image said indicator as the bowling ball travels down said bowling lane.

3. An apparatus as claimed in claim 2, wherein said bowling lane includes a foul line, and wherein said imaging device is positioned behind said foul line.

4. An apparatus as claimed in claim 2, wherein said indicator comprises an arcuate mark positioned on said bowling ball.

5. An apparatus as claimed in claim 4, wherein said arcuate mark extends between a spin axis of the bowling ball and a contact ring of the bowling ball.

6. An apparatus as claimed in claim 1, wherein said detecting means is positioned above said bowling lane.

7. An apparatus as claimed in claim 1, further comprising a velocity sensor positioned adjacent to said bowling lane for sensing a velocity of said bowling ball as said bowling ball travels down said bowling lane.

8. An apparatus as claimed in claim 1, further comprising a position sensor positioned adjacent to said bowling lane for sensing a lateral position of said bowling ball as said bowling ball travels down said bowling lane.

9. An apparatus for analyzing bowling technique, comprising:

a bowling lane having a foul line, a pin deck and a longitudinal axis;

a plurality of pins positioned on said pin deck;

a bowling ball launched down said bowling lane toward said bowling pins; and means for determining a launch angle of said bowling ball as said bowling ball is launched down said bowling lane, wherein said means for determining a launch angle comprises at least two position sensors positioned adjacent said bowling lane at respective lane positions that are substantially closer to said foul line than to said pin deck, said position sensors being separated from each other by a predetermined longitudinal distance, wherein each position sensor determines a horizontal location point of said ball on the lane at the respective lane position, and wherein said determining means uses the horizontal location points and said predetermined longitudinal distance to calculate said launch angle.

10. An apparatus as claimed in claim 9, wherein said position sensors comprise sonic positioning devices for emitting a sonic signal toward said bowling ball and receiving said sonic signal after said sonic signal has echoed off of said bowling ball.

11. An apparatus as claimed in claim 9, wherein said two position sensors are positioned within about twenty feet of said foul line.

12. An apparatus for analyzing bowling technique, comprising:

a bowling lane having a foul line, a pin deck and a longitudinal axis;

a plurality of pins positioned on said pin deck;

a bowling ball adapted to be launched down said bowling lane toward said bowling pins; and means for determining an entry angle of said bowling ball as said bowling ball enters said pin deck, wherein said means for determining an entry angle comprises at least two position sensors positioned adjacent to said bowling lane at respective lane positions that are substantially closer to said pin deck than to said foul line, said position sensors being separated from each other by a predetermined longitudinal distance, wherein each position sensor determines a horizontal location point of said ball on the lane at the respective lane position, and wherein said determining means uses the horizontal location points and said predetermined longitudinal distance to calculate said entry angle.

13. An apparatus as claimed in claim 12, wherein said position sensors comprise sonic positioning devices for emitting a sonic signal toward said bowling ball and receiving said sonic signal after said sonic signal has echoed off of said bowling ball.

14. An apparatus as claimed in claim 12, wherein said two position sensors are positioned within about ten feet of said pin deck.

15. An apparatus for analyzing bowling technique, comprising:

a bowling lane;

a plurality of pins positioned on one end of said bowling lane;

a bowling ball launched down said bowling lane toward said pins; and means for determining a coefficient of friction between said bowling ball and said bowling lane.

16. An apparatus as claimed in claim 15, wherein said means for determining a coefficient of friction comprises at least two velocity sensors positioned adjacent to said bowling lane and separated from each other by a predetermined distance, said velocity sensors sensing a velocity of said bowling ball as said bowing ball travels down said bowling lane.

17. An apparatus as claimed in claim 16, wherein said velocity sensors comprise speed traps having at least two trap switches positioned a predetermined spacing from each other.

18. An apparatus as claimed in claim 16, wherein said bowling lane includes a pin deck defining a location of said bowling pins, and wherein said velocity sensors are positioned within about twenty feet of said pin deck.

19. A method of analyzing a bowling technique, comprising the steps of:

attaching an indicator to a bowling ball;

launching the bowling ball down a bowling lane;

imaging the bowling ball as the bowling ball travels down the bowling lane;

counting the number of times the indicator appears over a period of time as the bowling ball travels down the bowling lane to achieve a number indicative of a spin rate of the bowling ball; and measuring a spin axis angle of the bowling ball as the bowling ball travels down the bowling lane.

20. A method as claimed in claim 19, wherein the indicator includes an arcuate mark, and wherein said step of attaching comprises the step of positioning the arcuate mark between a spin axis of the bowling ball and a contact ring of the bowling ball.

21. A method as claimed in claim 20, wherein said step of positioning comprises:

launching the bowling ball down the bowling lane to achieve an oil ring corresponding with the contact ring; and positioning the arcuate segment approximately perpendicular to a portion of the oil ring.

22. A method as claimed in claim 19, further comprising the step of displaying a number indicative of the spin rate of the bowling ball.

23. A method as claimed in claim 19, further comprising the step of determining a coefficient of friction between the bowling ball and the bowling lane.

24. A method of analyzing a bowling technique, comprising the steps of:

attaching an axis mark to the spin axis of a bowling ball;

launching the bowling ball down a bowling lane;

imaging the bowling ball as the bowling ball travels down the bowling lane; and measuring a spin axis angle of the axis mark relative to a reference mark of the bowling lane.

25. A method as claimed in claim 24, wherein said step of attaching an axis mark comprises the steps of:

launching the bowling ball down the bowling lane to achieve an oil ring on the bowling ball; and positioning the axis mark at a location that approximately defines a center axis of the oil ring.

26. A method as claimed in claim 24, wherein said step of measuring a spin axis angle comprises the steps of:

viewing the bowling ball from above;

locating a measured line extending between the center of the bowling ball and the axis mark; and measuring the spin axis angle between the measured line and the reference mark.

27. A method as claimed in claim 24, wherein the reference mark is a line that is parallel to a longitudinal axis of the bowling lane.

28. A method as claimed in claim 24, further comprising the step of displaying a number indicative of the spin axis angle of the bowling ball.

29. A method of determining a coefficient of friction between a bowling ball and a bowling lane, comprising the steps of:

measuring velocities ($v_1$, $v_2$) of the bowling ball at two locations;

measuring positions ($d_1$, $d_2$) of the bowling ball between the same two locations;

calculating a friction coefficient of the bowling lane utilizing the velocities and the positions of the bowling ball at the two locations; and displaying the friction coefficient.

30. A method as claimed in claim 29, wherein the bowling lane includes an oiled portion and an un-oiled portion, and wherein both of the two locations are in the un-oiled portion.

31. A method as claimed in claim 29, wherein said step of calculating a frictional coefficient comprises utilizing the formula:

$$(v_1^2-v_2^2)/(d_1-d_2),$$

wherein $v_1$, $v_2$, $d_1$ and $d_2$ are real numbers not limited to whole numbers or integers.

* * * * *

UNITED STATES PATENT AND TRADEMARK OFFICE

CERTIFICATE OF CORRECTION

PATENT NO : 6,110,052

DATED : August 29, 2000

INVENTOR(S) : David G. Sprager, et al.

It is certified that error appears in the above-identified patent and that said Letters Patent are hereby corrected as shown below:

Column 8, line 35, delete "adapted to be".

Signed and Sealed this

First Day of May, 2001

*Attest:*

Nicholas P. Godici

NICHOLAS P. GODICI

*Attesting Officer*

*Acting Director of the United States Patent and Trademark Office*